US005275762A

United States Patent [19]

Burgess

[11] Patent Number: 5,275,762

[45] Date of Patent: Jan. 4, 1994

[54] AERATOR

[76] Inventor: Harry L. Burgess, 5400 Memorial Dr. #511, Houston, Tex. 77007

[21] Appl. No.: 66,894

[22] Filed: May 25, 1993

Related U.S. Application Data

[63] Continuation-in-part of Ser. No. 787,038, Nov. 4, 1991, Pat. No. 5,213,718, which is a continuation-in-part of Ser. No. 641,057, Jan. 14, 1991, abandoned.

[51] Int. Cl.[5] ..... B01F 3/04

[52] U.S. Cl. ..... 261/4; 261/121.2; 261/120; 261/93; 210/242.2

[58] Field of Search ..... 261/121.2, 4, 120, 93; 210/242.2

[56] References Cited

U.S. PATENT DOCUMENTS

| | | | |
|---|---|---|---|
| 2,515,538 | 7/1950 | Wall | 261/121.2 |
| 2,590,581 | 3/1952 | Shirley | 261/121.2 |
| 2,865,618 | 12/1958 | Abell | 261/121.2 |
| 3,017,951 | 1/1962 | Wiley . | |
| 3,189,334 | 6/1965 | Bell . | |
| 3,214,149 | 10/1965 | Budzien . | |
| 3,279,768 | 10/1966 | Niewiarowicz . | |
| 3,347,371 | 10/1967 | Verbaere . | |
| 3,371,789 | 3/1968 | Hense . | |
| 3,635,342 | 1/1972 | Mourlon et al. . | |
| 3,756,578 | 9/1973 | McGurk . | |
| 3,800,462 | 4/1974 | Coyle . | |
| 3,815,277 | 6/1974 | Murray . | |
| 3,837,627 | 9/1974 | Sence et al. . | |
| 3,846,516 | 11/1974 | Carlson . | |
| 3,920,779 | 11/1975 | Abele . | |
| 3,940,461 | 2/1976 | Martin et al. . | |
| 4,003,796 | 1/1977 | Muller et al. . | |
| 4,029,724 | 6/1977 | Muller et al. . | |
| 4,051,204 | 9/1977 | Muller et al. . | |
| 4,086,306 | 4/1978 | Yoshinaga . | |

(List continued on next page.)

FOREIGN PATENT DOCUMENTS

| | | |
|---|---|---|
| 2823515 | 12/1979 | Fed. Rep. of Germany . |
| 3208825 | 9/1983 | Fed. Rep. of Germany . |
| 688308 | 3/1953 | United Kingdom . |

OTHER PUBLICATIONS

"WaterBuster Cordless Pump-4140-Operating Instructions," Attwood Subsidiary Steelcase Inc, Lowell Mich. 49331-0260.

"Mino-Mizer Live Bait Aerator," HyPark Speciality Co., Inc., 1988.

*Primary Examiner*—Tim Miles

*Attorney, Agent, or Firm*—Browning, Bushman, Anderson & Brookhart

[57] ABSTRACT

An aerator comprises a centrifugal pump including a rotary impeller with a plurality of blades defining an upwardly opening, axially oriented eye, inwardly of the inner ends of the blades, the blades also defining a plurality of flow passages therebetween extending generally radially outwardly from the eye. The pump further comprises an impeller housing generally surrounding the impeller and including an upper wall closely overlying a major portion of the blades, radially outermost, and defining an axially upwardly opening inlet over the impeller eye, the housing further defining at least one laterally opening outlet communicating with the radially outer extremities of the flow passages. The housing is adapted to resist rotation with respect to a container of liquid in which a pump may be disposed. The pump is also adapted to stay in a given depth range in such container. A housing extension conduit, fixed with respect to the impeller housing, extends upwardly with respect to the impeller housing. A throughway of the conduit has its lower end aligned with the inlet of the impeller housing. The length of the conduit is sufficient to position an upper end of the throughway above the liquid. A lower portion of the conduit at least partially defines a liquid intake disposed below the surface of the liquid and opening above the upper wall of the impeller housing. This liquid intake is sized to pass less liquid per unit time than the pump can handle.

16 Claims, 5 Drawing Sheets

U.S. PATENT DOCUMENTS 4,096,215 6/1978 Albrecht .
4,140,737 2/1979 Hauser .
4,142,972 3/1979 Nebeker et al. .
4,240,990 12/1980 Inhofer et al. .
4,255,360 3/1981 Jeffries ..... 261/121.2
4,280,911 7/1981 Durda et al. .
4,290,885 9/1981 Kwak .
4,297,214 10/1981 Guarnaschelli .
4,328,175 5/1982 Roeckel et al. .
4,348,288 9/1982 Yoshinaga et al. .
4,382,804 5/1983 Mellor .
4,409,100 10/1983 Rajendren .
4,437,765 3/1984 Seeger .
4,448,685 5/1984 Malina .
4,454,077 6/1984 Litz .
4,465,645 8/1984 Kaelin .
4,620,925 11/1986 Allen .
4,687,585 8/1987 Ramshaw .
4,732,682 3/1988 Rymal .
4,829,698 5/1989 McDonald .
4,853,124 8/1989 Terada .
4,917,577 4/1990 Stirling .
4,994,177 2/1991 Bogar, Jr. ..... 261/121.2
5,009,816 4/1991 Weise et al. .
5,021,165 6/1991 Kalnins .
5,077,932 1/1992 Hetherington ..... 261/121.2
5,085,809 2/1992 Stirling ..... 261/120

AERATOR

CROSS-REFERENCE TO RELATED APPLICATION

This is a continuation-in-part of prior co-pending U.S. application Ser. No. 07/787,038, filed Nov. 4, 1991, now U.S. Pat. No. 5,213,718, which in turn is a continuation-in-part of prior U.S. application Ser. No. 07/641,057, filed Jan. 14, 1991, now abandoned.

BACKGROUND OF THE INVENTION

This invention relates to a device for aerating or otherwise gasifying a body of liquid, e.g. a container in which live fish or other marine animals are to be maintained, a waste treatment pond, or the like. More particularly, this aerator may be used for aerating water in a bait bucket or tank in which live bait such as minnows or shrimp are to be sustained.

When marine life is to be sustained in an aquarium or other container, it is necessary to provide appropriate means for aerating the water in the container if the marine life is to remain viable. For example, it is common practice when fishing, particularly in salt water, to utilize live bait such as minnows, and it is desirable to maintain the minnows in a viable condition over fairly long periods of time while the fishing vessel is away from the dock.

DESCRIPTION OF THE PRIOR ART

Unlike the present invention, prior art aerators have tended to be tailored for particular usages, e.g. aeration of aquaria or bait buckets, aeration of waste treatment ponds, aeration of fluids being handled in food processing, aeration of fluids being handled in various industrial processes, etc. Even then, these aerators have often presented problems, and possibly none so much as those intended for use in aerating small containers in which fish, shrimp, or other aquatic animals are being maintained.

A very basic problem, which may occur with certain prior art aerators, no matter what their intended use, is that they do not maximize the amount of air introduced to the liquid. An example is the type exemplified by U.S. Pat. Nos. 3,800,462 to Coyle, 3,815,277 to Murray, and 4,255,360 to Jeffries, which simply pump water up and out of the bottom of the container, spraying it out above the surface of the water, whereby it is somewhat aerated as it falls back into the tank. As will be appreciated, this can also be messy, particularly if the bait bucket is being carried around by hand or in a boat.

Some aerators use centrifugal pumps to which air is introduced from the surface. However, where these are utilized in the conventional, inlet-downward position, as in U.S. Pat. No. 4,917,577 to Stirling, they can become air-locked and clogged with bait or parts thereof, and they also fail to maximize the amount of air introduced to the water, even when running properly.

In still other aerators, e.g. in U.S. Pat. No. 4,051,204 to Muller et al., even though a centrifugal impeller is run inlet upward, it is still operated in a conventional manner in that it has enough free-flow access to water to remain fully primed. As will be explained more fully below, this has proved, surprisingly, to be not only unnecessary, but also disadvantageous, when the centrifugal pump is being used for aeration.

The Muller et al. apparatus would also appear to produce unnecessary frictional drag and heat generation due to the type of impeller used therein. This same type of problem is exacerbated even further in such items as that disclosed in British Patent No. 688,308, wherein a very large integral structure, including shaft, is rotating in the liquid being stirred and aerated.

Both of the last-mentioned patents also have small passageways where bait or parts thereof can become lodged. In addition to clogging small passages or openings, the small, filament-like feelers and legs of shrimp can cause problems with devices such as those shown in U.S. Pat. No. 4,297,214 and British Patent No. 688,308. These devices have the further problem of a rotary shaft extending upwardly from the impeller through the liquid. Shrimp feelers and legs and other debris tend to wind around the rotary shaft and exacerbate fouling and clogging problems.

SUMMARY OF THE INVENTION

The present invention provides an aerator that, while suitable for the special problems of aerating containers in which aquatic animals are maintained, is also very versatile in that it can be used for many other purposes as well. It is relatively simple, maximizes aeration, minimizes motor-loading and heat generation, does not airlock, and avoids clogging and jamming when used with small solids, such as bait fish or shrimp.

"Aerator" is used herein in a broad sense to describe a device for introducing air or any other gas into water or any other liquid. Since a typical application is in introducing air into water in a live bait container, this description will frequently refer to air and water for convenience, without limiting the scope of the invention.

The aerators of the prior applications of which this is a continuation-in-part were based on the rather surprising discovery that, in order to serve as an improved aerator, a centrifugal pump should be modified so that it draws into its cavitation zone a quantity of air that is ordinarily considered undesirable in the running of a centrifugal pump, and is usually avoided. In order not only to allow, but to positively cause this, the pump was adapted to maintain a disposition of the pump casing with the liquid inlet opening upwardly and capable of taking in liquid from a body of liquid in which the pump is disposed and also take a substantial amount of air or other gas from an area above that body of liquid to the pump's cavitation zone. This was accomplished, in part, by running the pump "upside down," i.e. with its axial inlet opening upwardly.

It was recognized that, preferably, the pump would thus take in so much air that it would surge, or be on the verge of surging. Indeed, it was recognized in the prior applications that, when the net positive suction head ("NPSH") available is less than that required under any particular condition of operation, cavitation will occur, but that, where the pump is being used as an aerator, then within reasonable limits, this is not undesirable, as would normally be the case, but surprisingly, may enhance the aeration capabilities of the device. The orientation of the pump in accord with the parent inventions (inlet up), and the introduction of air into the eye of the impeller, reduced the head, resulting, at least in some cases, in a certain amount of cavitation.

In accord with preferred embodiments of the present invention, two primary measures are employed to encourage cavitation to the point that the pump is continually vacillating between primed and non-primed conditions; more specifically, the establishment of a vortex in the eye of the impeller is resisted, and instead it is endeavored to maintain a turbulent condition in a relatively thin layer of water above the eye of the impeller (there being air above that). It has been found that this not only maximizes the amount of air introduced into the water, but does it so efficiently that battery life is increased and there is no appreciable rise in the water temperature. These last advantages are particularly important when aerating bait buckets or other containers of live marine animals.

The two primary measures that achieve this, generally stated, are: resisting the tendency of the impeller housing to rotate in the water, and limiting the water intake to less than the pump capacity.

The first of these may be accomplished, in the case of a floating pump/aerator, by the configuration of the outlet(s) in the impeller housing. In the absence of means to resist, a floating centrifugal pump's housing will normally rotate in the water in the same direction as the impeller when the pump is running, albeit more slowly. In accord with the present invention, the outlet(s) are configured to expel effluent in a direction having a substantial tangential component oriented so as to tend to counter-rotate the impeller housing in the opposite direction from the impeller.

Since sufficient rotation of the housing in either direction can facilitate the establishment of a standing vortex, the configuration of the outlet(s) is preferably adapted to limit the counter-rotation of the housing to a speed less than that required for the formation of a vortex, and even more preferably, to just cancel the natural tendency to rotate in the same direction as the impeller, so that there is little or no net impeller rotation in either direction.

In the case of a non-floating aerator, housing rotation is resisted by means for fixedly positioning the housing with respect to the liquid container in which it is to operate. This does not mean that it must be immovably fixed, but only that it will stay in essentially one place during operation. If the weight provided by the aerator is not sufficient to achieve this, some means such as a suction cup, a bracket, or a clip may be provided.

The second primary measure, i.e. limiting of water intake, is, in preferred embodiments, accomplished by means of the lower portion of a relatively wide conduit fixed with respect to the housing and extending from a point near the pump housing inlet to a point above the liquid to provide for the ingress of air. With the above construction, a cavitation eye will form at the top of the impeller when the impeller is rotated by the motor. When the centrifugal pump rotates, the vacuum formed in the cavitation zone by rotation of the impeller will draw air through the conduit into the cavitation eye where a portion of the air will be entrained in the water. Excess air can escape upwardly through the inlet and/or conduit, thereby preventing air locking of the impeller, as will typically occur if air accumulates in the cavitation zone of a centrifugal pump mounted in the "normal" pump operating position, with the inlet opening downwardly.

The lower end of this conduit at least partially defines a liquid intake, below the surface of the liquid and above the upper (inlet-defining) wall of the impeller housing. This intake is sized to be a limiting design factor in how much liquid the pump can take in per unit time. (Other operating conditions, such as depth, also affect this.) For example, it provides less flow area than any surrounding strainer or other part of the flow path for incoming liquid. Importantly, this intake is sized to pass less liquid per unit time than the pump can handle.

Thus, the pump is forced to take in air from the conduit as well as liquid, and because of the turbulent, rather than vortical, flow, a maximum amount of this air will be mixed or entrained with the liquid as it is taken into the impeller.

The conduit is preferably relatively wide, as compared to the pump inlet (about the same width or more), so that the pump has a virtually unlimited air supply. In preferred embodiments, the conduit is solid-walled, and the intake is defined by a gap between the lower end of the conduit and the upper wall of the impeller housing. If the aerator is of the floating type, the conduit may comprise a flotation ring.

A number of additional features of preferred embodiments contribute to the above and other advantages.

In preferred embodiments, the pump comprises a water impermeable motor casing, fixed to the impeller housing, in which casing a motor is mounted, and also includes a self-contained power source for the motor, e.g. a battery pack. A drive shaft operably connected with the motor extends through the top of the motor casing and the hubbed vaned centrifugal rotary impeller is mounted on the drive shaft above the motor in the impeller housing.

The impeller is preferably of the type wherein the flow passages between the blades are at least partially open upwardly, and an upper housing wall at least partially overlies them.

In preferred embodiments of the floating versions of the invention, the pump is ballasted, to set its center of gravity such that, if the pump is placed in the water other than in its operating position, it will automatically turn to its operating position.

In all of these embodiments of the invention, the pumping of a combination of air and water not only serves to aerate the water, but by introducing air into the water below the surface, this aeration is more effective than in systems wherein water is sprayed upwardly and cascades down into the body entraining air with it. Furthermore, the pumping of a combination of air and water so reduces the demands on the motor, that the device can operate for a very long time on a single battery or charge. As mentioned, the reduced demand also minimizes heating of the water by the operating pump and its motor.

Also, the invention is uncomplicated; it can be made by performing relatively simple modifications to a conventional centrifugal pump, and is thus relatively economical and trouble-free in operation.

Other features and advantages of the invention will be made apparent by the following detailed description, the drawings and the claims.

DETAILED DESCRIPTION

Figure 1:
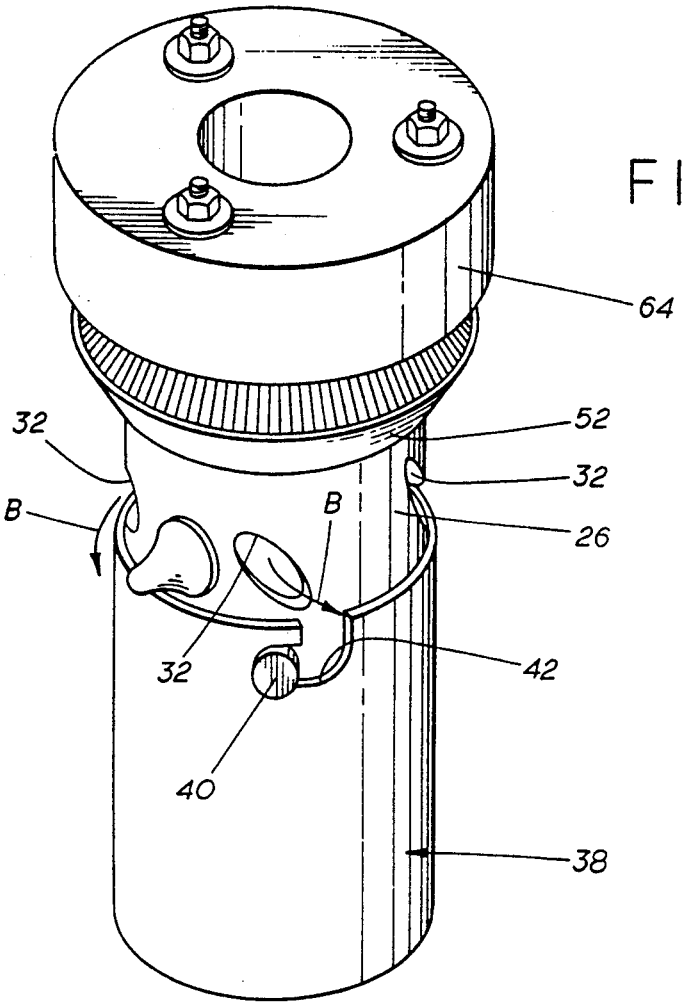
FIG. 1 is a perspective view of a first (floating) embodiment of aerator according to the present invention.
Figure 2:
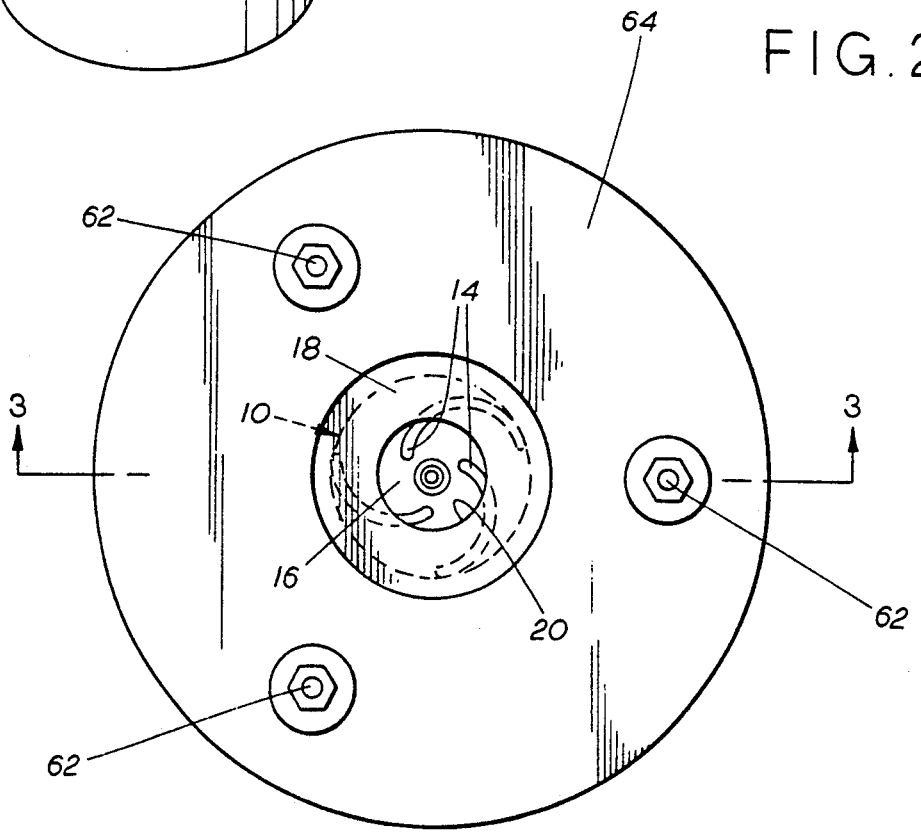
FIG. 2 is a top plan view of the aerator of FIG. 1.
Figure 3:
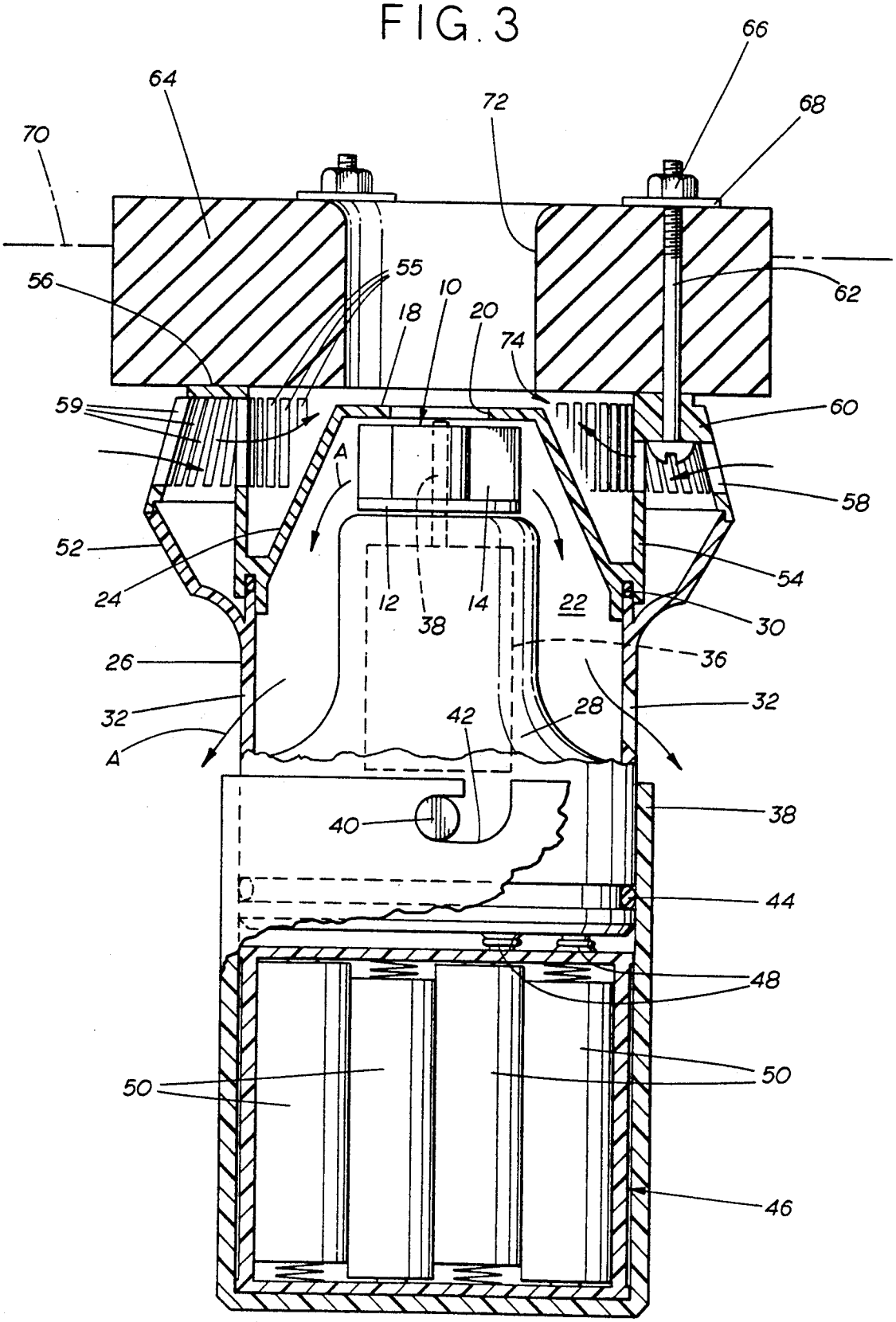
FIG. 3 is a longitudinal sectional view taken on the line 3—3 in FIG. 2.

FIGS. 1-3 illustrate a first embodiment of aerator according to the present invention. This first embodiment is a type of aerator that is intended to float in the tank or other container of liquid to be aerated. The tank will contain water at a level represented by line 70. The "tank" may be any suitable container, such an aquarium in which pet fish are kept, an ice chest in which live bait are taken while fishing, or any other suitable container. It will also be readily appreciated that the invention can be used to aerate or gasify any body of liquid, whether in a relatively small container such as just mentioned, or larger, e.g. a waste treatment pond, either man-made or natural.

The aerator comprises a centrifugal pump including a hubbed, vaned, rotary impeller 10. Impeller 10 includes a disk-like bottom plate 12 and a plurality of blades 14 rigidly mounted on the upper surface of the plate 10. The blades 14, and the flow passages defined between them, extend generally radially from a central eye 16 defined inwardly of the radially inner ends of blades 14, which do not extend all the way in to the center line or axis of the impeller 10. It can be seen that the blades 14 and flow passages curve radially and tangentially in a well-known manner. "Generally radial," as used herein, includes such conventional configurations; more specifically, the term means that if the direction in which such a blade or passage extends, at various points along its length, respectively, is broken down into radial and tangential components, the radial component will be at least half as large as the tangential component over a major portion of the blade length.

The pump also includes an impeller housing, which in this case also houses other parts of the apparatus, to be described below. In terms of its relation to the impeller 10, it is important that the impeller housing have an upper wall 18 that closely overlies a major portion of the blades (i.e. at least half their length), that portion being disposed radially outermost. Since the impeller has no upper plate or disk, but rather has the flow passages between the blades opening upwardly, this closely overlying upper wall 18 of the housing confines the fluid as it flows through the outer parts of the flow passages between the blades 14.

However, upper wall 18 of the impeller housing has a central, axially upwardly opening inlet 20 that lies over and exposes the eye 16 of the impeller and the innermost ends of the blades 14. Thus, the aerator floats in the tank below the normal level 70 of water in the tank and in an inverted position from that in which such a pump is normally mounted. That is to say, the motor 36 (described below) is mounted so that the drive shaft and the impeller extend above the motor rather than extending below the motor as is usually the case, and the inlet 20 opens upwardly as shown.

Through this inlet 20, water enters in an axial direction and passes into the eye 16 and the innermost parts of the flow passages. When the impeller is rotating relative to the housing, as will be described below, the water is accelerated by centrifugal force, its direction of flow changed from axial to radial as it is thrown outwardly through the flow passages between the blades 14. Thence, the fluid passes into a generally annular outlet plenum area 22 defined between the side walls 24 and 26 of the impeller housing and the motor casing 28, to be described below.

The upper part 24 of the impeller housing side wall is frustoconical, extending integrally downwardly and radially outwardly from the outer edge of upper wall 18. It can be seen that upper side wall portion 24 extends downwardly somewhat below the impeller 10. At its lower end, it forms a downwardly opening annular groove 30 that receives the upper edge of cylindrical lower side wall portion 26, and a seal is preferably provided at this joint.

Several circumferentially spaced outlet openings 32 open laterally through wall portion 26 well below the impeller 10. Thus, the water will be moving downwardly, as indicated by the arrows A, as it moves from the impeller 10 to the outlet openings 32. As best shown in FIG. 1, the outlet openings 32 are angled downwardly and circumferentially. Thus, as the water continues its downward movement in passing out through openings 32, it is given a circumferential or tangential component of direction by the configuration of the openings 32. In the example shown, this component is in the counterclockwise direction, as indicated by the arrows B in FIG. 1. It can be appreciated that this will tend to cause the floating aerator to rotate in the water in a clockwise direction, by way of reaction. The configuration of the outlet openings 32, which tends to cause clockwise rotation of the floating aerator, is designed to be counter to the normal direction of rotation of the impeller 10, which is counterclockwise.

In the absence of such configuration of the inlet openings 32, or other means for resisting counterclockwise rotation, the housing 18, 24, 26, etc. would tend to rotate in the same direction as the impeller 10, i.e. counterclockwise, albeit at a slower rate of speed. This, in turn, facilitates the establishment of a vortex in the liquid above and within the eye of the impeller. For reasons to be explained more fully below, the present aerator is designed to resist the formation of such a vortex, in contravention to conventional centrifugal pump practice.

However, should the impeller housing begin to rotate too fast in the opposite direction from that of the impeller, that too could facilitate the establishment of a vortex. Therefore, the openings 32 are preferably configured to provide just enough tendency to counter-rotation to approximately balance the rotational tendency imparted by the impeller 10, so that there is little or no net rotation of the aerator in the water. However, it is also feasible to design the outlets to counter-rotate (or permit same-direction rotation) at a speed less than that required for the establishment of a vortex. The downward component of the fluid being discharged also helps to send the aerated water deeper into the tank, thereby more thoroughly aerating the entire body of water.

An electric motor 36 is disposed within casing 28, which in turn is disposed within walls 24 and 26. As previously mentioned, the outlet plenum area 22 is defined between motor casing 28 and housing walls 24 and 26. The motor 36 has a drive shaft 38 extending upwardly and out through the end of its casing, and fixed to the hub of impeller 10, to rotate the impeller, as previously described.

The lower end of housing wall 26 is detachably received within and connected to a cup-like bottom housing part 38. These parts are detachably connected by one or more radial pins 40, carried on the outside of wall 26, each of which fits into a respective corresponding J-slot 42, opening into and extending from the upper edge of part 38. Wall 26 is preferably sealed with respect to part 38 as indicated at 44.

Part 38 houses a self-contained power source in the form of a battery pack 46, for supplying power to the motor 36 via well-known electrical connection means, including contacts 48. The J-slot connectors 40, 42 allow the bottom part 38 of the housing to be removed when it is necessary to change the batteries 50. A switch 27, which can selectively complete or break the connection between the battery pack 46 and the motor 36, is accessible from the outside of housing wall 26.

A generally frustoconical branch lip 52 is integrally molded with wall portion 26, and extends generally radially outwardly and upwardly from a point spaced below the upper edge of wall portion 26, which as aforementioned is connected to wall portion 24.

Wall portion 24, in turn, has a double-walled strainer integrally formed therewith. The inner part of this strainer is a cylindrical structure 54 extending upwardly from the vicinity of the groove 30, in radially spaced and circumferentially surrounding relation to wall 24. From the upper end of the inner strainer wall 54, an integral annular flange 56 extends radially outwardly. An outer frustoconical strainer wall 58 extends downwardly and outwardly from the outer end of flange 56, in radially spaced and circumferentially surrounding relation to inner strainer wall 54, and its lower end is connected by a suitable joint to the upper edge of lip 52.

Each of the strainer walls 54 and 58 has a plurality of vertically elongated slots, 55 and 59, respectively, extending radially therethrough. This double-walled strainer is particularly advantageous where small solids are present in the liquid being aerated. For example, if the container of liquid being aerated is a bait container, containing live shrimp, legs and feelers of the shrimp often become detached. Although the wide upwardly opening inlet construction helps to prevent these items from clogging the pump, the strainer 54, 58 is still desirable for its assistance in diminishing, or even eliminating, the number of such items that get into the vicinity of the impeller at all. Perhaps more importantly, the strainer 54, 58 prevents whole shrimp from being sucked into the pump inlet. It can also be seen that the large annular configuration of the plenum area 22 facilitates escape of any shrimp feelers or the like that may pass through the impeller 10.

In three circumferentially spaced spots, the flange 56 is thickened in the vertical direction, as indicated at 60, and a vertical bore is provided therethrough to receive a respective screw 62. Screw 62 passes through an aligned bore in an annular flotation collar 64, and its end extends upwardly from collar 64, for receipt of a nut 66 and shim 68, whereby the collar 64 is attached to the housing. Collar 64 may be formed of synthetic foam or other suitable buoyant material, and is adapted to be adequate to support the entire apparatus in a floating position with the collar 64 bridging the exterior water level 70, as shown.

Thus, collar 64 forms an upstanding housing extension conduit with its central throughway 72 aligned with inlet 20. Throughway 72 is preferably wide as compared to inlet 20. By this is meant that it is about the same width as inlet 20, or even wider, as shown. This not only allows a virtually unlimited supply of air to the impeller 10, but also eliminates small, tight places near the top of the impeller, wherein any shrimp feelers or the like that might manage to bypass the strainer or splash over the top of the collar 64 might otherwise lodge.

It will be noted that the strainer wall 54 is taller than the upper impeller housing wall 18, and abuts the underside of collar 64, whereby the lower end of collar 64 is spaced above wall 18. Thus, an annular gap 74 is formed between the lower end of collar 64 and the wall 18. This annular gap opens generally laterally and forms a limiting part of the flow path for water into the inlet 20. That is to say, the gap 74 is sized to provide less cumulative flow area than the only other arguable restriction or limiting point upstream of inlet 20, i.e. the strainer 54, 58.

The slots 55 and 59 are more than adequate, in size and number, to provide enough cumulative flow area for liquid to satisfy the pump. However, gap 74 does not. Rather, and in contravention to conventional centrifugal pump practice, gap 74 is specifically designed to limit the flow of fluid to the pump, so that, if the pump is operating in its normal range of speeds, and at the depth range at which collar 64 will hold it, the gap 74 will not pass as much liquid per unit time as the pump can handle. Thus, the pump will take in air through the throughway 72 of collar 64. Gap 74 is preferably made small enough so that the pump will continually vacillate between a primed condition and a non-primed condition.

This, coupled with the aforementioned resistance to the formation of a vortex, will cause a high degree of turbulence in the water flowing over wall 18 into inlet 20. Furthermore, due to the relatively small size of gap 74, the internal water level within throughway 72 will be very low, much lower than the level 70 outside, so that this turbulent water over wall 18 will be in a relatively thin layer. Under ideal conditions, this layer of turbulent water corresponds in thickness to the height of gap 74. (If the gap 74 were large enough to allow the pump to be satisfied fully by water flow, the water level would rise higher in throughway 72.) All of these factors cooperate to maximize the amount of air that is thereby entrained in the water as it enters and passes through the pump.

These practices are, as mentioned, directly contrary to conventional centrifugal pump practice in many respects. However, the present inventor has found that, when such a pump is used for aeration purposes, breaking these conventional rules, surprisingly, results in many advantages. The pumping of both air and water, and its discharge well below the surface of the water, provides excellent aeration. The thin layer of turbulent water above the eye of the impeller enhances this aeration. In addition, the reduced demands on the motor when the pump is handling a large quantity of air allow the device to operate for a long time on a given battery or charge, and also makes for a longer life of the motor itself. Furthermore, the energy expended is so low that there need be no appreciable elevation in the temperature of the water. This, in turn, is partly due to the fact that the aerator is so efficient that it can be made relatively small in size.

In one exemplary experiment, an aerator approximately of the type shown in FIGS. 1-3 was placed in a small container holding only three times the volume of the pump, and run for 6 hours. The water temperature was measured at the beginning and end of this operation, and did not differ by even one degree. This can be important when the aeration is being done to keep live bait alive, and could also be important in certain other industrial or like aeration processes.

An aerator according to the invention can be made by fairly simple modifications to an existing pump. For example, an aerator essentially of the type shown in FIGS. 1-3 was made from an Attwood "Mini King 360" pump, available from Attwood Pumps of Lowell, Minn. Means for mounting the pump to a tank were removed, and a floatation collar 64 was added. The battery pack 46 was used as ballast, and the collar 64 appropriately sized with respect thereto, so that the pump would not only float inlet upwards at the desired depth, but would turn itself to that position if placed in the water in another position.

The position of collar 64 with respect to housing wall 18 was empirically adjusted to provide the desired size gap 74.

The original pump had a single tubular outlet, this was removed and the remaining opening in the side wall of the housing plugged. Specially configured outlet openings 32 were formed in the housing wall.

Of course, an aerator according to the present invention can also be custom designed and made.

Figure 4:
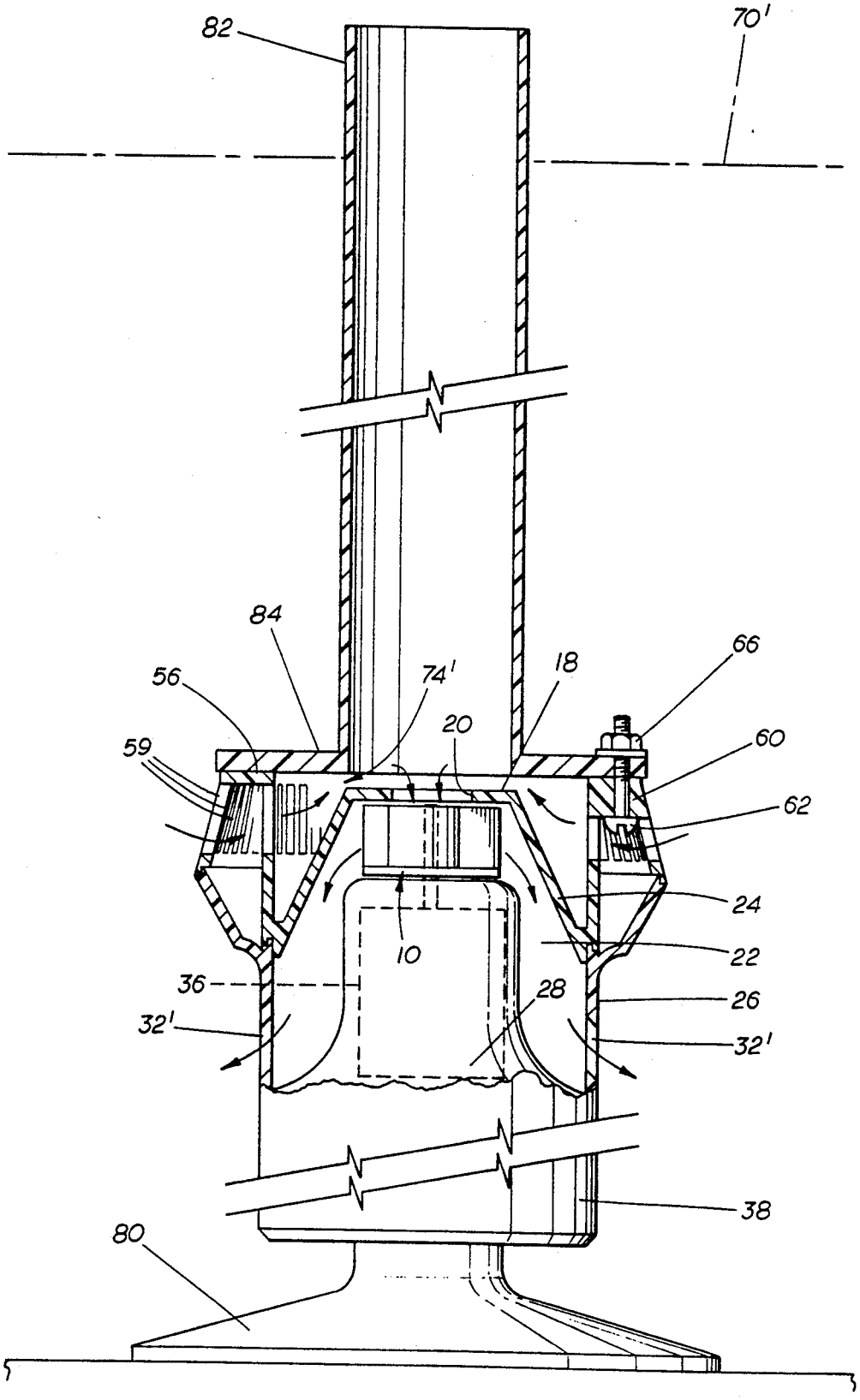
FIG. 4 is a view similar to that of FIG. 3 showing a second (fixed) embodiment.

Turning to FIG. 4, there is shown a second embodiment of the invention that is adapted to be fixedly mounted to the liquid container, rather than floating therein. In many respects, the aerator of FIG. 4 is virtually identical to that of FIGS. 1-3. Parts of the aerator of FIG. 4 that are identical to the corresponding parts of the aerator of FIGS. 1-3 have been given like reference numerals, and will not be described again. The main difference is that, whereas the aerator of FIGS. 1-3 is meant to float in a container of water or other liquid, the aerator of FIG. 4 is meant to be fixedly mounted on the container, and more specifically, on the bottom of the container. This functional difference is related to two major structural differences.

First, a suction cup 80 is carried by the bottom of the lowermost housing member 38, so that the aerator can be affixed to the bottom of the container. It will be appreciated that this attachment will prevent rotation of the housing in the water. Therefore, the outlet openings do not have to be of a particular shape, as in the preceding embodiment, and accordingly, they have been designated by the numerals 32' to indicate that they might be different in shape from the openings 32. Location of the aerator at the bottom of the tank is desirable for providing deep aeration.

The other major difference is that, instead of the annular flotation collar 64, a much longer tubular conduit 82 is secured to flange 56. Conduit 82 is not buoyant, and is therefore not as thick, i.e. not as great in outer diameter, as flotation collar 64. Therefore, it is provided with a radially outwardly extending annular flange 84 at its lower end whereby it may be connected to flange 56 by nuts 62 and bolts 66, as in the first embodiment. The inner diameter of conduit 82, i.e. the width of its throughway, is comparable to that of collar 64. Therefore, it is relatively wide as compared to the inlet 20 in the upper wall 18 of the impeller housing.

In both embodiments, there are means for maintaining the aerator at a given depth range in the body of liquid to be aerated. In the first embodiment of FIGS. 1-3, that means is the flotation collar 64, and the depth range is measured from the surface 70 of the liquid. In the embodiment of FIG. 4, that means is the suction cup 80, and the depth will be a function of the level 70' depth to which the container is filled. However, as a practical matter, an aerator will probably be designed for a container in a given size range, so that the general depth will be known in advance. In any event, once the container is filled to a desired depth, and the aerator is fixed therein, it will be held at the same depth throughout its operation. Thus, for purposes of this specification, "given depth range" or the like will be very loosely construed to simply mean that the position of the aerator with respect to the top or bottom of the liquid does not change drastically during a given operation.

The conduit 82 can simply be made long enough to bridge the water line 70' for all reasonable anticipated uses of a given aerator, and in any event, it is a simple matter to remove and replace the conduit 82 by a different length conduit, if need be.

It will be understood that the rate of flow of water into the pump is a function of a number of factors including the sizes of the various passageways through which the water must flow, the speed at which the impeller is rotated, and the depth or hydraulic head. Thus, while the lower end of conduit 82, like that of collar 64, cooperates with the upper wall 18 of the impeller housing to define an annular intake gap 74', and while the gap 74' is likewise sized to pass less water per unit time than the pump can handle, the size of the gap 74' may need to be somewhat different from that of gap 74, since the two embodiments of aerator are intended to operate at different depths.

Designing various of the features described above may be done empirically. For example, if a pump similar to that shown in FIGS. 1-3 and 5 is purchased as an off-the-shelf item, the vertical spacing of the conduit 64 or 82 from the wall 18 can be varied using annular shims of various sizes, until, by simply looking down through the center of the conduit while the impeller is rotating, one observes the low internal liquid level and turbulent action desired, and illustrated in the detailed view of FIG. 4. Then, for a production model, the shims can be replaced by a suitably sized integral conduit.

Similar experiments can be done with respect to the counter-rotation effect of the outlet structures in floating aerators, although it has been found that some off-the-shelf pumps will perform satisfactorily in this regard.

Figure 5:
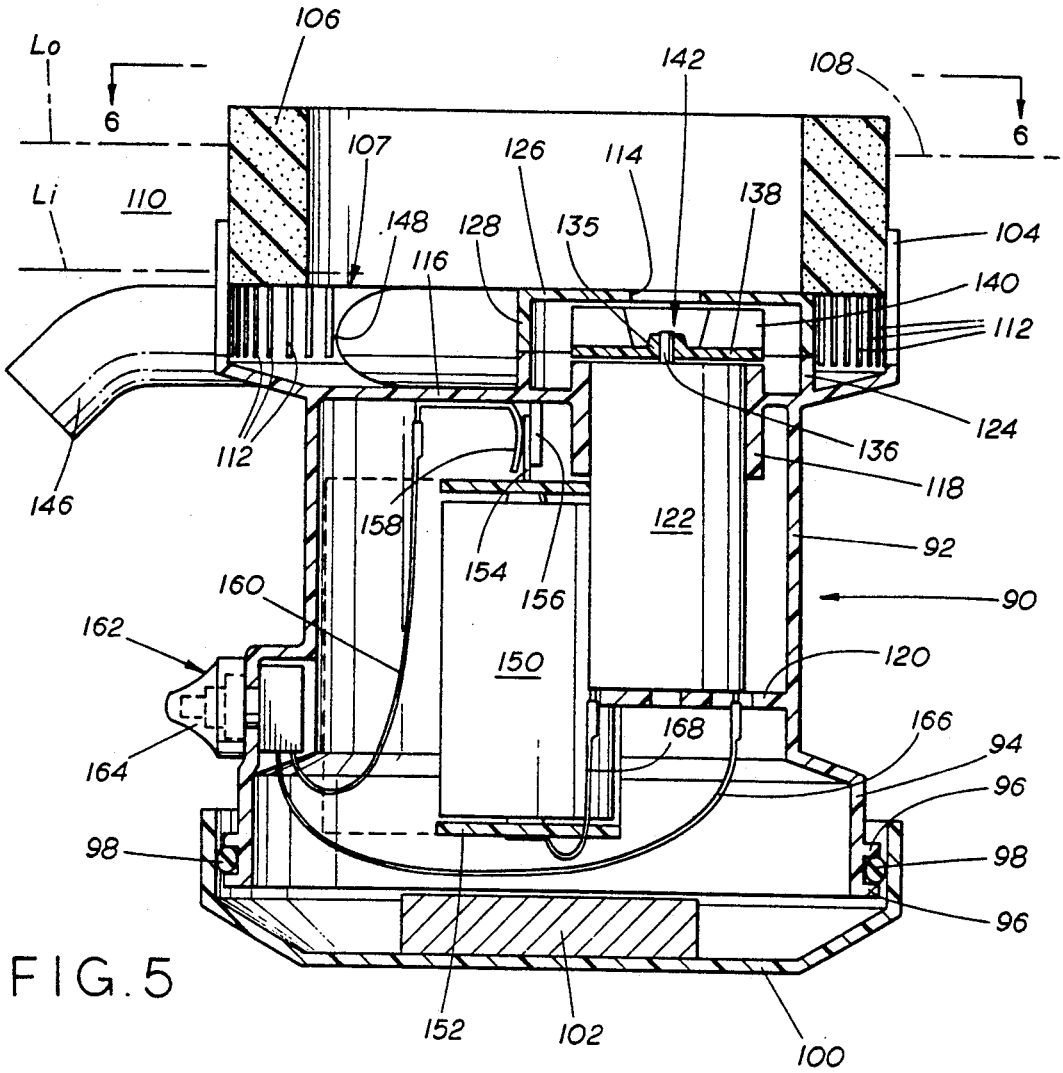
FIG. 5 is a longitudinal sectional view of a third (floating) embodiment.
Figure 7:
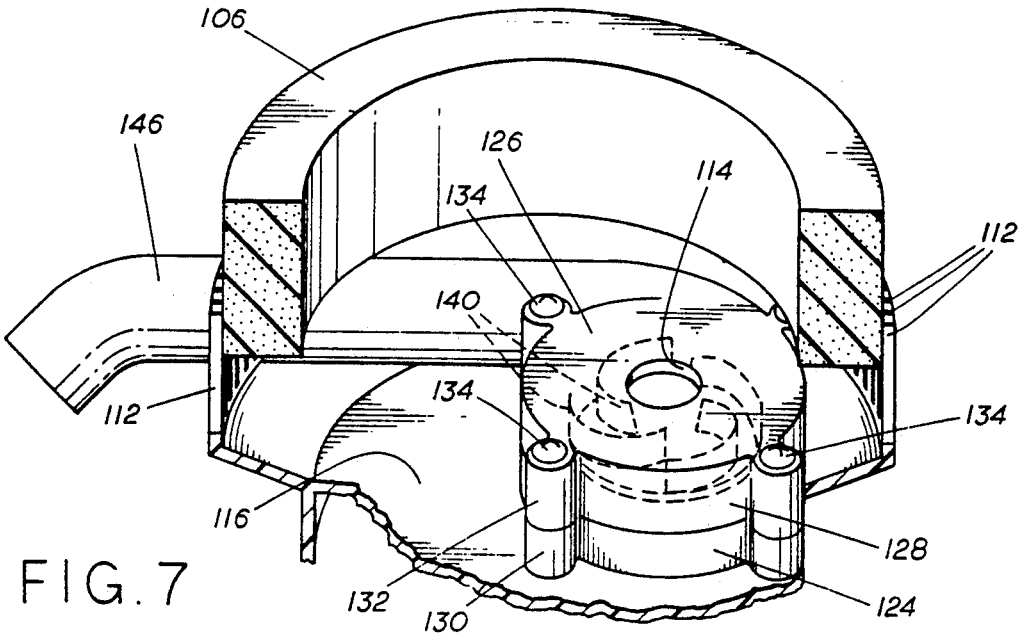
FIG. 7 is a partial, broken, perspective view of the embodiment of FIG. 5.
Figure 6:
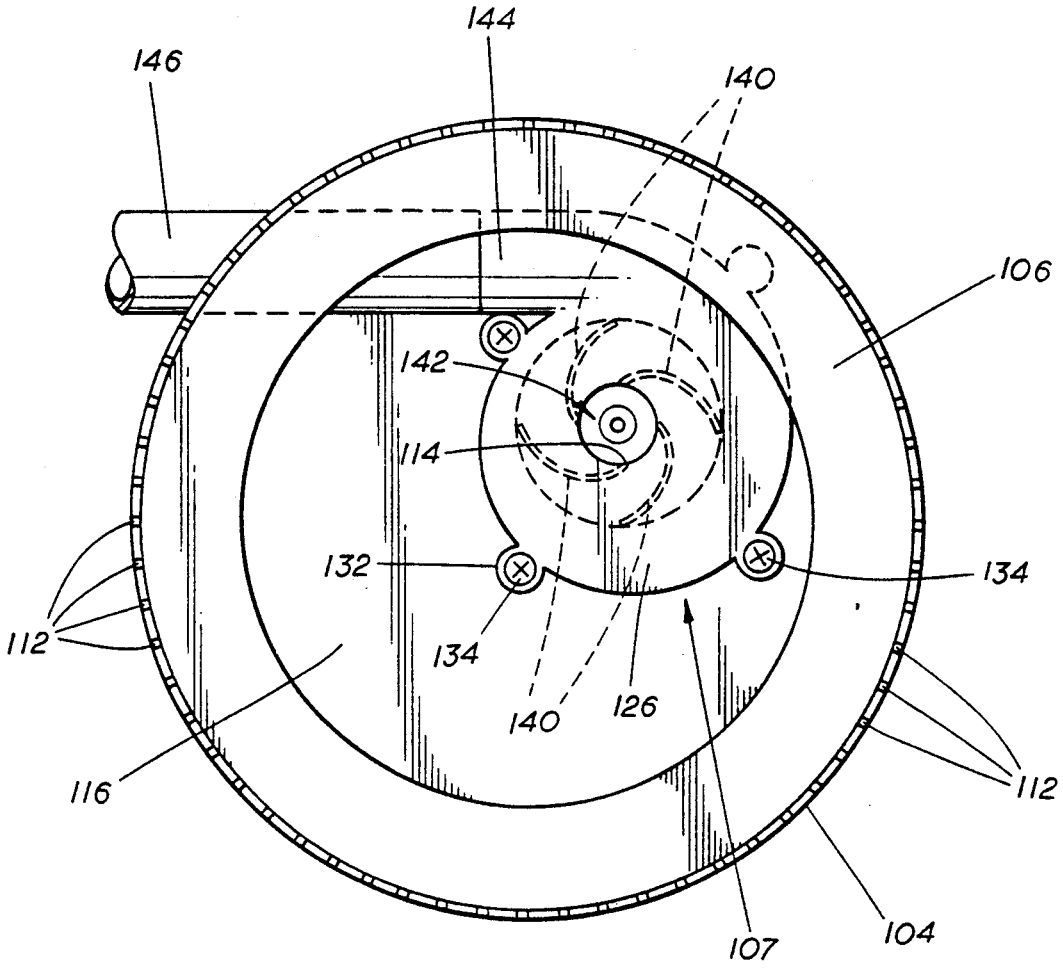
FIG. 6 is a top plan view of the embodiment of FIG. 5.

Turning now to FIGS. 5-7, there is shown an aerator essentially identical to that in parent U.S. application Ser. No. 07/787,038. In said parent application, the apparatus of FIGS. 5-7 was shown and described as forming a vortex above the impeller inlet in operation, and in some circumstances, such an apparatus can do that. However, now that the advantages of discouraging a vortex in favor of turbulence has been discovered, it has likewise been realized that, depending on the anticipated operating conditions, the structure of FIGS. 5-7 may produce the desired effects with or without minor modifications.

Before describing these effects and modifications, the basic structure of FIGS. 5-7 will be described.

The aerator of FIGS. 5-7 comprises an otherwise conventional, buoyant, submersible, centrifugal pump, such as an Attwood "WaterBuster" pump, that has been modified for use as an aerator 90 according to the present invention. The device 90 includes a housing including a generally cylindrical main body portion 92 molded of a suitable synthetic material, and enlarged at its upper and lower ends as shown. The enlarged lower end forms a downwardly depending skirt 94 on the outer side of which are formed parallel annular flanges 96 between which is mounted an O-ring type seal 98. A cover 100, separately formed of a similar synthetic material, is removably fitted over the outer portion of skirt 94, being sized to sealingly engage the O-ring 98. Cover 100 may be releasably held on skirt 94 by any well-known means, such as bayonet-type connections (not shown).

In modifying a pump for use as aerator 90, a ballast weight 102 is fixed in the lower end of the pump, as by gluing or bolting to cover 100, as shown. It is to be understood that the conversion of a conventional pump into the aerator 90 may also involve the removal of other weighted parts, e.g. a plate that might extend across the skirt 104 at the opposite enlarged end of housing 92. In the event that, instead of converting a conventional pump for this use, a pump is custom made for this unique aerator use, it may be unnecessary to add or subtract weighted members, but rather, the relative positions and shapes of the essential working parts of the pump can be designed and arranged to provide the desired effect, which is to locate the center of gravity such that, if the pump is simply dropped into a body of liquid at random, and lands in any position other than the operating position shown in FIG. 5, it will automatically turn itself to the operating position. As mentioned, in the embodiment shown, weight may be removed from the end that is desired to be uppermost in the aerator operating position, and weight 102 may be added to the lower end.

As previously mentioned, the upper end of housing 92 is likewise enlarged, and includes an annular skirt 104. A buoyant cylinder 106 of foam or the like is fitted coaxially within the outer or upper end of skirt 104 so that, together, skirt 104 and cylinder 106 form an enclosure the length of which ensures that the enclosure will extend above the level $L_o$ of the liquid in which the aerator 90 will be floating and operating. One reason for this is that skirt 104 is provided with slits 112 so that it serves as a strainer, to allow liquid 110 to enter the enclosure 104, 106, but keep out the shrimp or other bait. To prevent such bait from passing over the upper edge of the enclosure, it should be ensured that enclosure extends above the surface level $L_o$ of the liquid.

Also, enclosure 104, 106 serves as a housing extension conduit, performing many of the same functions as conduits 64 and 82 of the preceding embodiments, as will be described in greater detail below. For the time being, it is noted that, in order for enclosure 104, 106 to serve as such a conduit, including limiting the amount of liquid that can flow into the pump, at least the upper portion 106 thereof must be solid-walled as shown.

As will be described more fully below, the aerator 90 should float in the liquid 110 with its inlet 114 below the surface level $L_o$ so that it takes in water, but close enough to the surface $L_o$ so that it will also take in air. The appropriate distance is interrelated with the size of the water intake gap defined between the lower end of solid-walled portion 106 of the enclosure or conduit 104, 106 and the upper wall 126 of the impeller housing proper (described below). In this case, that gap 107 opens vertically, rather than laterally, and is a sort of crescent-moonshaped area determined by the eccentric relationship between housing wall 126 and conduit portion 106. Although conduit 106 is aligned with inlet 114, it is eccentric with respect thereto, the portion of conduit 106 depicted on the right in the Figures being contiguous housing wall 126, whereas the portion at the left is spaced widely therefrom.

As mentioned, the proper depth at which the inlet 114 is disposed in use and the proper size of gap 107 are interrelated. For the embodiment shown, if the impeller speed is relatively fast and the liquid is water, it might be necessary to modify this ratio in order to achieve the desired internal water level (within enclosure 104, 106) and turbulence (as opposed to vortex). For example, it might be necessary to make gap 107 smaller, as by downsizing the inner diameter of enclosure 104, 106, and/or it might be necessary to increase the ballast 102, to cause the device to float at a lower depth, correspondingly increasing the length of conduit 106 so that it will bridge the surface $L_o$ of the liquid. However, in other working environments, e.g. with a liquid of different viscosity and/or a different impeller speed, the apparatus just as shown may achieve the desired results without any modification. In order to ensure that the gap 107 defines the limit on water flow per unit time, the number and/or size of slits 112 may be increased as shown (over slits 72 in the immediate parent of this application).

In the embodiment shown, cylinder 106 is buoyant, and thus serves as a flotation collar to help the aerator 90 float in a proper operating position. In addition, since, when the aerator 90 floats at the optimum distance from the surface 108, skirt 104 does not extend above that surface, flotation collar 106 in the embodiment shown is also sized to extend the height of the enclosure that it forms jointly with skirt 104.

It will be appreciated that, depending upon the details of the pump that is modified for aerator use, the inherent buoyancy of the pump, particularly with proper adjustment of the ballast, may be such that no additional flotation collar is needed. In that case, the foam cylinder 106 could be replaced by a simpler and thinner extension of the skirt 104. On the other hand, additional flotation devices may be added that do not extend above the edge of the skirt, and indeed may not be annular, nor even attached to the skirt 104, but could be located elsewhere about the device 90.

Integral with the generally cylindrical outer wall 92 of the main body portion of the housing are several internal walls. A transverse wall 116 extends generally across the housing, at the juncture between the smaller diameter central portion 92 and the enlarged upper portion that includes skirt 104. At one side, lateral wall 116 has an opening surrounded by an upstanding cylinder 118 formed integrally with wall 116 and extending both above and below that wall. Cylinder 118 receives the upper end of the electric motor 122, which is supported on an internal shelf 120. For simplicity, shelf 120 is shown as being formed integrally with housing part 92. However, as is well known in the art, either shelf 120 or at least a part of cylinder 118 would be separately formed, and affixed to the remainder of the housing, e.g. by screws, in order to allow assembly of the motor 122 into the pump.

An annular rim 124, also integrally formed with parts 92 and 116, extends upwardly from wall 116 in surrounding relation to the upper part of cylinder 118. Along with the enclosed portion of wall 116, and the upper part of cylinder 118, rim 124 forms the lower portion of the impeller housing 122 that is encompassed in the overall housing structure. The upper end of the motor 122 completes this by closing or filling the opening formed within cylinder 118.

The upper half of the impeller casing is formed by a separate member including a horizontal plate 126 that forms the upper wall of the impeller housing. It closely overlies the impeller blades 140 and the upwardly opening passages formed therebetween, and has a central aperture 74 that serves as the inlet. An integrally molded, downwardly depending annular rim 128 is sized to match with rim 124. Integrally formed about the peripheries of the two rims 128 and 124 are respective aligned ears 130 and 132 (FIG. 7) that are internally threaded to receive screws 134 for securing the two halves of the impeller casing together. It is noted that the upper surface of the top half of the impeller casing 126, 128 serves as a stop for flotation collar 106, so that it cannot slip all the way down into skirt 104 thereby blocking off the strainer slits 112. Even if flotation collar 106 is glued or otherwise positively affixed on skirt 104, rather than simply friction fitted therein, it is helpful to have such a stop surface to properly position the collar 106 when it is being fixed in place.

As in the preceding embodiment, the impeller housed in impeller housing 124, 126, 128 includes a hub 135 fixed to a rotary shaft 136 that protrudes upwardly from the motor 122 and is rotated thereby. The bottom plate 138 of the impeller is formed integrally with and extends radially outwardly from the hub 135. Blades 140 spiral outwardly from a void eye 142, in upstanding relation to plate 138.

As previously mentioned, the aperture 114 in plate 126 forms the liquid inlet of the impeller housing, which is centered over the eye 142 of the impeller. As best seen in FIGS. 6 and 7, the impeller housing has a lateral, more specifically tangential, liquid outlet formed by opposed, aligned extensions of the upper and lower portions of the impeller housing, the extension of the upper part 126, 128 of the impeller casing being shown at 144. A piece of flexible tubing 146 is fitted into the outlet 144, and extends out through an opening 148 in the housing so that the aerated liquid is discharged well into the body of liquid 110. Tube 146 has a 45° elbow, directed downwardly at the free end, to discharge the aerated water deep into the tank.

As in the embodiment of FIGS. 1–3, the tangential configuration and orientation of the outlet structures 144, 146, etc., are designed to tend to counter-rotate the aerator just enough to offset its natural tendency to rotate in the same direction as the impeller in use.

Below wall 116, and to the side of the formations 118, 120 that hold the motor 122, there is a space for receipt of a battery pack, which may include several batteries 150 snapped into the contacts carried by a bracket-like holder 152. In a well-known manner, the bracket 152 and/or batteries held therein are configured to cooperate with interior surfaces of the housing to properly position the battery pack therein. When properly positioned, electrical connectors such as that shown at 154 are clamped between braces 156, formed integrally with the housing, and contacts 158. The particular contact 158 shown is connected by wire 160 with the switch mechanism 162, which in turn is protected from the liquid by an elastomeric cover 164. Switch 162 is also connected by wire 166 to motor 122 through an aperture in support 120, and motor 122 is connected with the batteries 150, as by wire 168, all as well-known in the art, and therefore simplified herein.

When the impeller 135, 138, 140 is rotated by motor 122, liquid is drawn down into inlet 114 and the eye 142 of the impeller, whence it is accelerated and propelled laterally outwardly between the impeller blades 140 and out through outlet 144, 146.

Due to the sizing of gap 107, the pump is not satisfied by the amount of water that can pass through that gap, and therefore it also takes in air from the space above the liquid. The limits on the water intake gap 107 keep the internal liquid level $L_i$(within enclosure 104, 106) relatively low, and together with the resistance to rotation of the aerator in the liquid, cause a turbulence that helps to entrain a maximum amount of this air into the liquid.

In the eye 142 of the impeller, at least a portion of the air or gas is entrained with the water, also sucked into the eye of the impeller, so that the water is aerated as it passes through the outlet 144, 146. Any excess air tending to build up in the eye of the impeller, and which might otherwise indefinitely air lock the pump, can, because of the upwardly facing orientation of the inlet 114, simply escape upwardly through the liquid 110 and back into the air space thereabove.

Because the aerator floats in an operating position that properly spaces the inlet 114 from surface 108, it is unnecessary to mount the aerator at a given level nor to maintain any particular liquid level in the tank.

It should be understood that various features of the different embodiments described above can be interchanged and/or combined. For example, a form of outlet shown in one embodiment could be utilized in the other embodiments. Still other modifications will suggest themselves to those of skill in the art. Accordingly, it is intended that the scope of the invention be limited only by the claims.

What is claimed is:

1. An aerator comprising:

a centrifugal pump including an impeller including a plurality of blades defining an upwardly opening, axially oriented eye inwardly of inner ends of the blades, the blades also defining a plurality of flow passages therebetween extending generally radially outwardly from the eye;

an impeller housing generally surrounding the impeller and including an upper wall closely overlying a major portion of the blades, radially outermost, and defining an axially upwardly opening inlet over the impeller eye, the housing further defining laterally opening outlet means communicating with radially outer extremities of the flow passages; and drive means for rotating the impeller relative to the impeller housing;

means associated with the impeller housing to resist rotation of the impeller housing with respect to a container of liquid in which the pump may be disposed;

means for causing the pump to stay in a given depth range in such container during operation; and a housing extension conduit fixed with respect to the impeller housing and extending upwardly with respect to the impeller housing with a throughway of the conduit having a lower end aligned with the inlet of the impeller housing, the length of the conduit being sufficient to position an upper end of the throughway above the liquid, an upper portion of the conduit, which upper portion is positioned to bridge the surface of the liquid, being solid walled, and a lower portion of the conduit at least partially defining a liquid intake disposed below the surface of the liquid and opening above the upper wall of the impeller housing, the liquid intake being sized to pass less liquid per unit time than the pump can handle.

2. The apparatus of claim 1 wherein said eye is in the center of the impeller.

3. The apparatus of claim 2 wherein the conduit is fixed with respect to the impeller housing so that a gap is formed between the lower end of the conduit and the upper wall of the impeller housing, the gap being the liquid intake.

4. The apparatus of claim 3 wherein the lower end of the conduit is spaced above the upper wall of the impeller housing so that the gap is annular and opens laterally.

5. The apparatus of claim 4 wherein the conduit is relatively wide as compared to the inlet in the upper wall of the impeller housing.

6. The apparatus of claim 5 wherein the conduit is solid-walled from end to end.

7. The apparatus of claim 5 wherein the gap is unobstructed.

8. The apparatus of claim 5 further comprising a strainer fixed with respect to the impeller housing, radially spaced from and generally surrounding the gap, and defining a plurality of relatively small fluid from openings communicating with the gap, cumulative fluid flow area provided by the small fluid flow openings being substantially greater than the flow area provided by the gap.

9. The apparatus of claim 5 wherein the aerator is buoyant, and wherein a flotation ring serves as the conduit as well as the means for causing the pump to stay in a given depth range.

10. The apparatus of claim 9 wherein the rotation resisting means comprises the outlet means of the impeller housing being configured to expel effluent in a direction having a substantial tangential component oriented so as to tend to counter-rotate the impeller housing in the opposite direction from the impeller.

11. The apparatus of claim 10 wherein the configuration of the outlet means is adapted to limit counter-rotation of the housing to a speed less than that required for formation of a vortex in the eye of the impeller.

12. The apparatus of claim 11 wherein the configuration of the outlet means is adapted to cancel the tendency of rotation of the impeller to rotate the impeller housing in the same direction as the impeller.

13. The apparatus of claim 5 wherein the rotation-resisting means, as well as the means for causing the pump to stay in a given depth range, comprises means associated with the impeller housing for fixedly positioning the impeller housing with respect to such liquid container.

14. The apparatus of claim 13 wherein said means for fixedly mounting the impeller housing comprises a suction cup.

15. The apparatus of claim 1 wherein the impeller is of the type wherein the flow passages between the blades are at least partially open upwardly.

16. The apparatus of claim 1 further comprising a self-contained power source for the drive means.

* * * * *

UNITED STATES PATENT AND TRADEMARK OFFICE

CERTIFICATE OF CORRECTION

PATENT NO. : 5,275,762

DATED : January 4, 1994

INVENTOR(S) : Harry L. Burgess

It is certified that error appears in the above-indentified patent and that said Letters Patent is hereby corrected as shown below:

In column 15, line 26, delete "from" and insert therefor --flow--.

Signed and Sealed this

Thirty-first Day of May, 1994

Bruce Lehman

*Attest:*

BRUCE LEHMAN

*Attesting Officer*

*Commissioner of Patents and Trademarks*